United States Patent [19]

Gordin et al.

[11] Patent Number: 5,016,150

[45] Date of Patent: May 14, 1991

[54] MEANS AND METHOD FOR INCREASING OUTPUT, EFFICIENCY, AND FLEXIBILITY OF USE OF AN ARC LAMP

[75] Inventors: Myron K. Gordin; Jim L. Drost, both of Oskaloosa, Iowa

[73] Assignee: Musco Corporation, Oskaloosa, Iowa

[21] Appl. No.: 424,161

[22] Filed: Oct. 19, 1989

[51] Int. Cl.[5] ..... F21V 7/12

[52] U.S. Cl. ..... 362/263; 362/296

[58] Field of Search ..... 362/261, 263, 264, 265, 362/269, 296, 427

[56] References Cited

U.S. PATENT DOCUMENTS

| | | | |
|---|---|---|---|
| 1,166,244 | 12/1915 | Norton . | |
| 1,249,133 | 12/1917 | Leddy . | |
| 1,397,801 | 11/1921 | Ensor et al. . | |
| 1,466,354 | 8/1923 | Drury . | |
| 1,560,408 | 11/1925 | Charlebois . | |
| 1,610,105 | 12/1926 | Moise . | |
| 1,639,753 | 8/1927 | Shelton . | |
| 1,660,067 | 2/1928 | Burtis . | |
| 1,691,209 | 11/1928 | Reynolds et al. . | |
| 1,751,111 | 3/1930 | Steele et al. . | |
| 1,867,138 | 7/1932 | Christmas . | |
| 1,926,675 | 9/1933 | Grunwald | 240/48.6 |
| 1,928,665 | 10/1933 | Irber | 240/48.6 |
| 1,990,666 | 2/1935 | O'Loughlin | 240/48.6 |
| 1,998,967 | 4/1935 | Raynolds | 176/34 |
| 2,018,155 | 10/1935 | Shananhan | 240/48.6 |
| 2,221,629 | 11/1940 | Birdseye | 176/34 |
| 2,277,563 | 3/1942 | Scott et al. | 240/41.3 |
| 2,440,832 | 5/1948 | Pennybacker | 176/122 |
| 2,578,451 | 12/1951 | Rex | 240/25 |
| 2,826,710 | 3/1958 | Lipscomb | 313/113 |
| 2,904,710 | 9/1959 | Beeninga et al. | 313/25 |

(List continued on next page.)

FOREIGN PATENT DOCUMENTS

| | | | |
|---|---|---|---|
| 210185 | 1/1956 | Australia . | |
| 752722 | 2/1967 | Canada | 362/263 |
| 860671 | 12/1952 | Fed. Rep. of Germany . | |
| D 17440 | 12/1956 | Fed. Rep. of Germany . | |
| 0132375 | 10/1979 | Japan . | |
| 53058 | 3/1982 | Japan . | |

OTHER PUBLICATIONS

"A New Generation of Metal Halide Lamps", *Journal of The Illuminating Engineering Society*, vol. 4, No. 2, pp. 106–110, Jan. 1975.

Venture Lighting Internaitonal, Pro-Arc Professional Metal Halide Lamps for General Lighting, Brochure (date unknown).

*Primary Examiner*—Ira S. Lazarus
*Assistant Examiner*—Richard R. Cole
*Attorney, Agent, or Firm*—Zarley, McKee, Thomte, Voorhees & Sease

[57] ABSTRACT

A means and method for increasing the amount, efficiency, and flexibility of use of light from an arc lamp. A first aspect of the inventnion includes an arc lamp in a lighting fixture wherein the arc tube positioned within the arc lamp has a longitudinal axis which is offset and/or tilted from the general longitudinal axis of the arc lamp. A second aspect of the invention involves methods and structures to position the arc tube of an arc lamp in a generally horizontal or vertical position irregardless of the aiming direction for the light from the arc lamp, and any related reflecting apparatus. The longitudinal axis of the arc tube can either be offset and/or tilted with respect to the longitudinal axis of the arc lamp, or they can be coaxial and the entire arc lamp can be positioned horizontally or vertically, offset and/or tilted from the aiming direction of the fixture and any attendant reflecting structure. A third aspect of the invention utilizes methods and structure to adjust the arc lamp to a desired rotational orientation with respect to a reflecting structure. A fourth aspect of the invention involves apparatus to allow desired mounting of the arc lamp to insure the desired orientation of the arc tube with respect to the arc lamp and to any mounting or reflecting structure.

15 Claims, 7 Drawing Sheets

U.S. PATENT DOCUMENTS

| | | | |
|---|---|---|---|
| 3,210,536 | 10/1965 | Elmer | 240/25 |
| 3,281,620 | 10/1966 | Miller | 313/113 |
| 3,325,638 | 6/1967 | Pfaff, Jr. et al. | 362/263 |
| 3,327,109 | 6/1967 | Franck | 362/263 |
| 3,459,934 | 8/1969 | Moore | 362/263 |
| 3,511,985 | 5/1970 | Muscovitch | 240/44.1 |
| 3,536,946 | 10/1970 | Kopelman et al. | 313/113 |
| 3,636,341 | 1/1972 | Miller | 362/263 |
| 3,661,685 | 5/1972 | Osteen | 362/263 |
| 3,949,211 | 4/1976 | Elms | 362/265 |
| 4,002,894 | 1/1977 | Kintz | 362/261 |
| 4,142,122 | 2/1979 | Koza | 313/220 |
| 4,161,014 | 7/1979 | Dey et al. | 362/263 |
| 4,261,029 | 4/1981 | Mousset | 362/283 |
| 4,261,030 | 4/1981 | Hernandez | 362/263 |
| 4,290,096 | 9/1981 | Szpur | 362/263 |
| 4,338,655 | 7/1982 | Gulliksen et al. | 362/281 |
| 4,341,975 | 7/1982 | Phillipp et al. | 313/25 |
| 4,351,018 | 9/1982 | Fratty | 362/215 |
| 4,398,239 | 8/1983 | DeVos et al. | 362/263 |
| 4,410,828 | 10/1983 | Ernest | 313/25 |
| 4,422,004 | 12/1983 | Knecht | 313/25 |
| 4,423,471 | 12/1983 | Gordin et al. | 362/96 |
| 4,428,039 | 1/1984 | Guimond et al. | 362/287 |
| 4,462,067 | 7/1984 | Altman | 362/268 |
| 4,506,315 | 3/1985 | Maekawa et al. | 362/308 |
| 4,521,834 | 6/1985 | Orr | 362/139 |
| 4,547,841 | 10/1985 | Quiogue | 362/269 |
| 4,548,449 | 10/1985 | Corsetti | 339/154 |
| 4,598,348 | 7/1986 | Richter | 362/390 |
| 4,610,498 | 9/1986 | Thomas | 339/186 R |
| 4,687,453 | 8/1987 | Lekebusch et al. | 445/4 |
| 4,722,711 | 2/1988 | Lekebusch et al. | 445/64 |
| 4,725,934 | 2/1988 | Gordin | 362/289 |

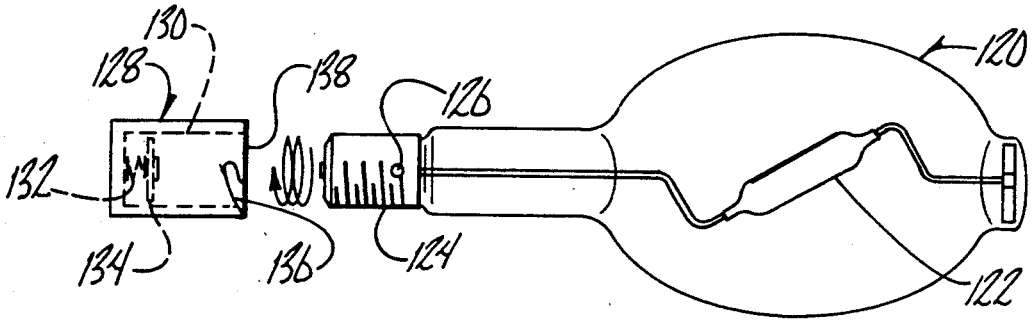
FIG. 13
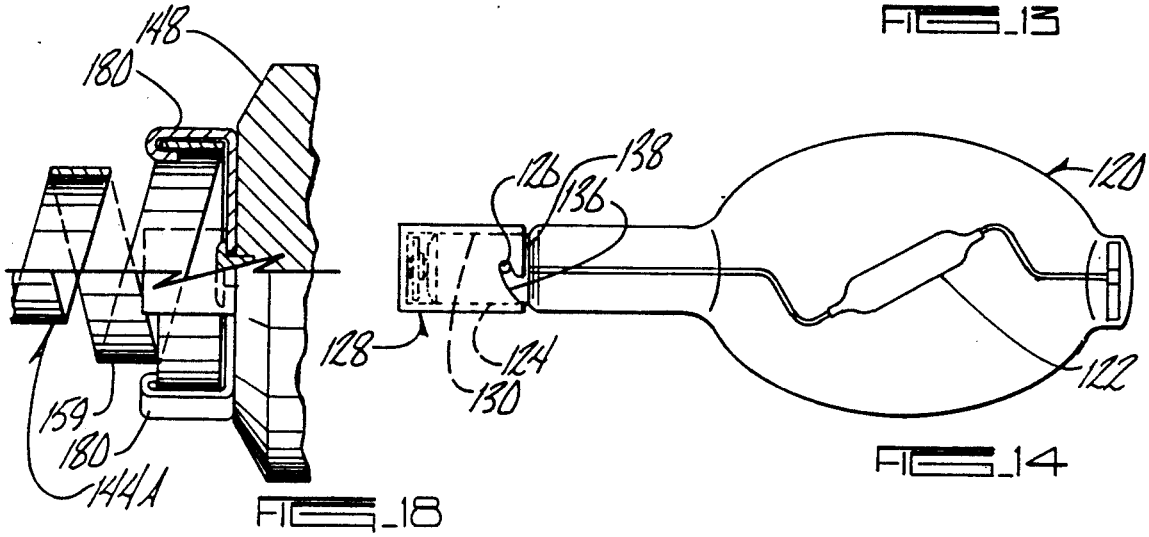
FIG. 14
FIG. 18
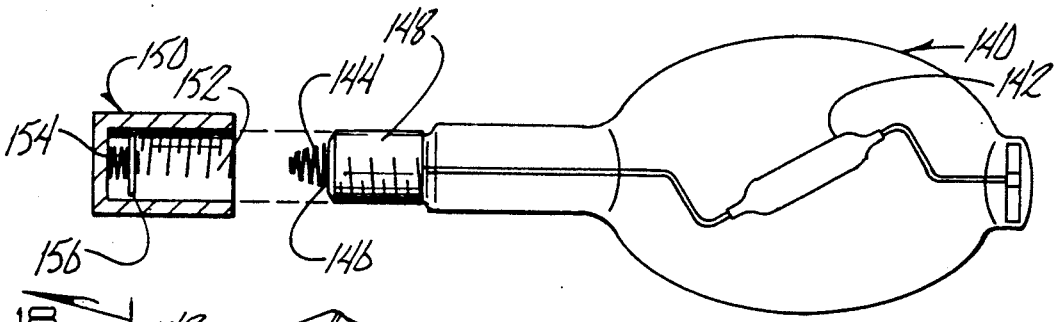
FIG. 15
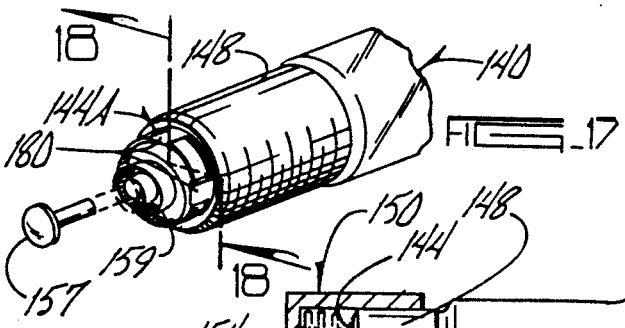
FIG. 17
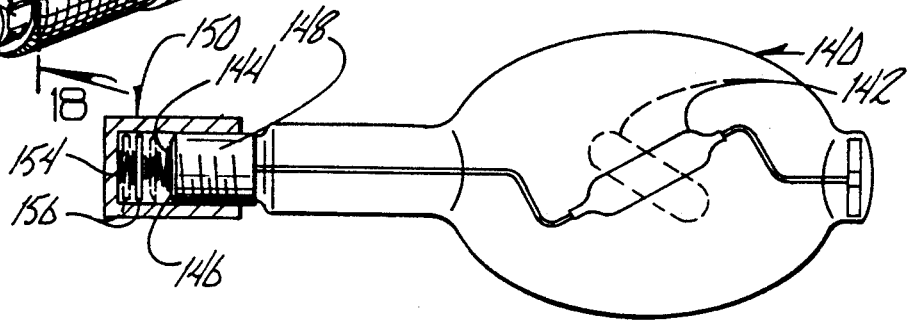
FIG. 16

MEANS AND METHOD FOR INCREASING OUTPUT, EFFICIENCY, AND FLEXIBILITY OF USE OF AN ARC LAMP

BACKGROUND OF THE INVENTION (a) Field of the Invention

The present invention relates to arc lamps, and particularly to mercury arc lamps and metal halide arc lamps; and further particularly to methods for increasing light output, efficiency, and flexibility of use of arc lamps, and for controlling and directing the light of arc lamps.

(b) Problems in the Art

Arc lamps represent an efficient, high-intensity source of light, particularly for high intensity, large quantity, or large area lighting. There are many different types of arc lamps, and mercury or metal halide varieties are commonly used for these applications.

Conventional arc lamps are available from a number of manufacturers and generally consist of a mounting apparatus, such as a screw-in or plug-in end, an arc tube, electrical connections connected between the screw-in end and the arc tube, and a bulb surrounding the arc tube, and at least some of the electrical connections.

As can be appreciated, and as is known to those skilled in the art, the arc tube is generally an elongated envelope made of quartz or some other high-temperature resistant yet substantially transparent material. The arc tube has a longitudinal axis which is generally aligned along the longitudinal axis of the entire arc lamp, which in the case of an arc lamp with a threaded end, extends between the threaded end and the opposite end of the lamp.

The arc tube is generally evacuated of air and is loaded with chemicals which facilitate creation of a high-intensity light arc between electrodes which extend into the arc tube, when electricity is applied to the electrodes. The bulb is also evacuated to provide temperature insulation and to provide protection to the arc tube.

In the case of a screw-in arc lamp, the lamp is generally used with a fixture having a threaded socket and a reflector mounted to the socket. The fixture is generally attached to some sort of mounting apparatus for mounting to a supporting structure. The fixture usually must be elevated and adjusted to allow each light to point downwardly to a desired lighting target area, or in a desired lighting direction or light aiming path.

A particular problem exists with respect to conventional arc lamps. Because the arc tube is generally aligned along the longitudinal axis of the arc lamp, there is no choice as to orientation of the arc tube once mounted in a fixture. Generally, the lamp and the arc tube are installed in the reflector coaxial with and symmetrical with the primary direction to which the light is directed from the reflector. In other words, the longitudinal axis of the arc tube is coaxial with the longitudinal axis of the arc lamp, which is coaxial with the longitudinal axis of the lamp socket means and reflector means (all defining the aiming direction or axis of the entire lighting fixture). Although this makes sense as far as symmetry and uniformity, it also contributes to a problem called "tilt factor" in mercury and metal halide lamps.

Frequently, the aiming direction of the high power arc lamps will be in an angularly downward orientation. Somewhere below horizontal but not downwardly vertical, the arc lamp and arc tube will therefore also be tilted downwardly with respect to horizontal. Because heat rises, tilting of the arc tube between horizontal and vertical (in any direction), will cause hotter areas to develop at the highest point of the arc tube, generally along the top of the arc tube. In turn, cooler areas will develop at the lowest points, generally along the lower part of the arc tube. These temperature differences, even though the overall temperature through and surrounding the arc tube is quite high, can cause precipitation of some of the loaded chemicals inside the arc tube. Such precipitation will cause clouding and blockage of light, and of course, will also make less of the chemicals available for production of the arc stream, which will also contribute to a reduction in the amount of light possible from the arc lamp. Other detrimental results can be drops in wattage of the lamp of, for example, 3 or 4 percent, and pressure changes in the lamp; all of which can adversely affect the consumption of power by the lamp, making it less efficient and less economical. This problem is thus called the "tilt factor". If a conventional arc lamp is tilted below horizontal, generally between 0° and 45° below horizontal, the tilt factor can result in light output loss of up to 20%.

It can therefore be seen that there is a significant need to solve the tilt factor problem with mercury and metal halide arc lamps. An improvement would represent an increase in efficiency and efficacy (light output, as in lumens per watt).

Another problem with all conventional arc lamps involves the ability to use the light output efficiently and effectively. An arc lamp emits light in such a manner that a majority of the light output radiates radially from the longitudinal axis of the arc tube. Relatively small amounts of light radiate directly from the ends of the arc tube.

Because there is always some light loss involved in reflection of light, it is generally most efficient to utilize as much light as possible which comes directly from a light source, as opposed to being reflected. It can therefore be understood that conventional arc lamps which have their arc tubes aligned along the longitudinal axis of both the arc lamp and the aiming axis of the reflector rely significantly on capturing the light emanated radially from the arc tube in the reflector and then redirecting it. If the arc tube did not point directly out of the reflector along its aiming axis, but was offset and/or tilted with respect to that aiming axis, more direct light could be utilized to the target area and reflection loss could be reduced. Also, the beam configuration emanating from the fixture can be made more effective by utilizing the offset and/or tilted arc tube with modifications to the reflector. For example, the reflecting properties of portions of the reflector can be changed to direct more light to the target area. The reflecting properties of the reflector can be altered or added-on features such as visors and shields can be added to the reflector and arc lamp. Inserts can also be added to the reflector. Control and redirection of light within the lighting fixture can be accomplished by using combinations of these types of elements with the offset and/or tilted arc tube. The offset or tilt can be accomplished either by modifying the arc tube in the arc lamp, or by modifying the reflector and fixture in relationship to a conventional non-offset and non-tilted arc tube.

It can therefore be seen that offsetting and/or tilting of the arc tube with respect to the aiming axis of the reflector and/or the target, could result in more direct light, which would eliminate some reflection loss. Offsetting and/or tilting of the arc tube may also have beneficial effects as to allowing a reflector to produce a better beam pattern to the target area. Such an increase in efficiency would deliver more light to the target area. More light could be delivered than with conventional fixtures; or the number of fixtures could be reduced to achieve the same light level.

Furthermore, offsetting and/or angling of the arc tube with respect to the aiming axis of the reflector and with respect to the target area may impact beneficially on glare and/or spill light control. In conventional arc lamps and reflector combinations, a substantial portion of the light is reflected upwardly, or outwardly, outside of the target area. This results many times in glare and spill. By enabling the arc to be offset and/or tilted with respect to the target area and/or the aiming axis of the reflector, it may be possible to eliminate some of the unnecessary spill and glare light, and direct more intensity and usable light to the target area. It may also be possible to more effectively use add-on elements to the reflector or arc lamp. The orientation of the arc tube can thus be utilized in combination with other glare control additions to conventional arc lamp and reflector assemblies to solve significant glare and spill problems, and increase the efficiency of the fixtures with respect to light at the target area.

It is therefore a principal object of the present invention to provide a means and method of increasing light output, efficiency, and flexibility of use of an arc lamp which improves upon or solves the deficiencies and problems in the art.

A further object of the present invention is to provide a means and method as above described, which can be utilized to solve tilt factor problems, light direction problems, and glare and spill problems in arc lamps.

Another object of the present invention is to provide a means and method as above described, which is adaptable to retrofitting of existing lighting fixtures, or is able to be manufactured in desired configurations, or a combination of both.

A further object of the present invention is to provide a means and method as above described, which can be combined with reflector assemblies to increase light, redirect light, and reduce glare and spill problems.

Another object of the present invention is to provide a means and method as above described, which is efficient, and economical to manufacture, install, and maintain.

Another object of the present invention is to provide a means and method as above described which is durable.

These and other objects, features and advantages of the present invention will become more apparent with reference to the accompanying drawings and specification.

SUMMARY OF THE INVENTION

The present invention is directed to solving problems encountered with conventional arc lamps. A first aspect of the invention involves offsetting or tilting the longitudinal axis of an arc tube of an arc lamp from the longitudinal or aiming axis of the arc lamp itself. Tilting can contribute to reducing the tilt factor in arc lamps such as mercury and metal halide lamps, which is caused by unequal temperatures in the arc tube when the arc lamp is not operated in a generally horizontal or vertical orientation.

Tilting and/or offsetting could, on the other hand, be used to produce a different light pattern to emanate from an arc lamp which may be beneficial for different uses, including allowing more light to emanate directly to the target area, allowing enhanced utilization of reflecting elements associated with the arc lamp, and combatting tilt factor problems. It could also be used to contribute to glare and spill control, by altering the light pattern emanating from the arc lamp.

The offsetting or tilting of the arc tube can be in any direction and in any orientation as is desired for a particular application. Conventionally, when used to reduce the tilt factor, the arc tube would be tilted in a vertical plane defined by and with respect to the longitudinal axis of the arc lamp so that the longitudinal axis of the arc tube would generally be horizontal or vertical in that vertical plane. However, all other orientations are possible.

Another aspect of the invention is to specifically orient the arc tube of any arc lamp so that it is generally horizontal (or vertical) in operation. This can be accomplished either with the tilting of the arc tube within the arc lamp, or by tilting a conventional arc lamp (where the arc tube's longitudinal axis is coaxial with the arc lamp's longitudinal axis), so that it is generally horizontal (or vertical) when the aiming axis of the reflector is oriented towards the target area for the light.

In another aspect, either by offsetting and/or tilting the arc tube from the longitudinal axis of the arc lamp, or offsetting and/or tilting the arc lamp from the aiming axis of the reflector, the orientation of the arc tube can be changed to cause a redirection or an altering of the light pattern from the arc tube with respect to any reflecting fixture. As previously explained, the light pattern emanating from an arc tube is such that by offsetting or tilting the arc tube with respect to the aiming direction, it may be possible for more light to directly emanate to the target area and increase the overall efficiency of the fixture. Furthermore, in a still further aspect of the invention, re-orienting the light pattern can have beneficial impacts upon glare and spill control.

Another aspect of the invention is the utilization of mounting structure which will insure desired rotational orientation of the arc lamp when mounted in a socket. This is particularly applicable when a certain orientation of an arc tube is desired, as there generally is no way to insure the same in conventional fixtures.

The present invention serves to reduce tilt factor, light loss, glare, or other problems involved with arc tubes. It allows the generation of beam patterns which deliver more light to the target. The result is fixtures with increased efficacy and lighting of higher efficiency. Many times it also improves the longevity of the arc lamps.

Figure 5:
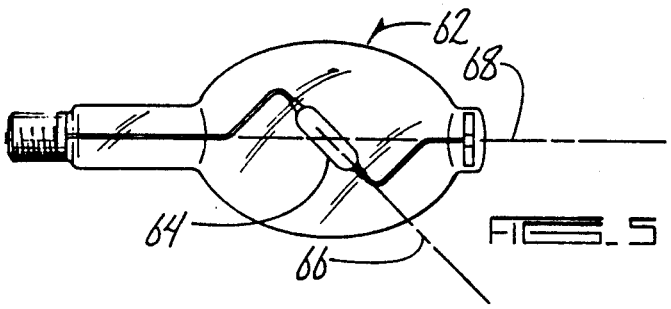
Figure 6A:
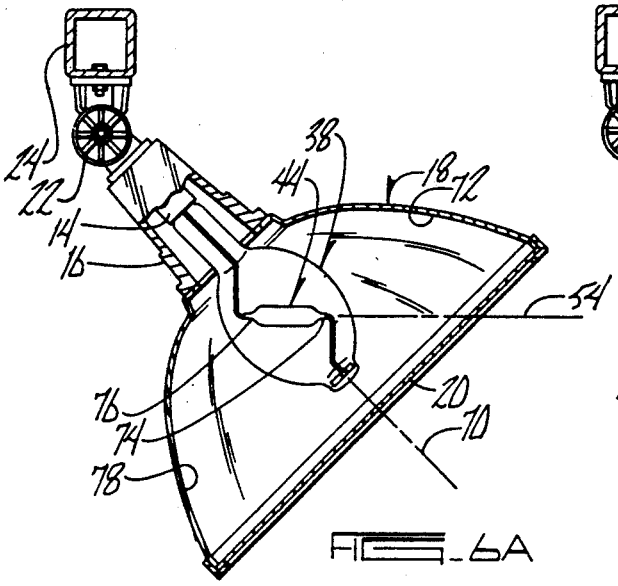
FIG. 6A is a side elevational view, with portions thereof in cross-section, showing the arc lamp of FIG. 5 positioned in a conventional light fixture, the arc lamp of FIG. 5 being rotatably mounted in the fixture so that the arc tube is generally horizontal.
Figure 6B:
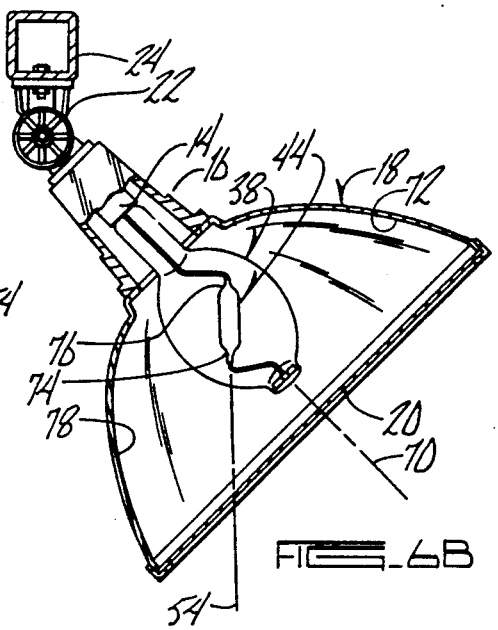

FIG. 6B is a side elevational view, with portions thereof in cross-section, showing the arc lamp of FIG. 5 positioned in a conventional light fixture, where the arc lamp of FIG. 5 is rotatably mounted so that the arc tube is in a generally vertical position.

Figure 7:
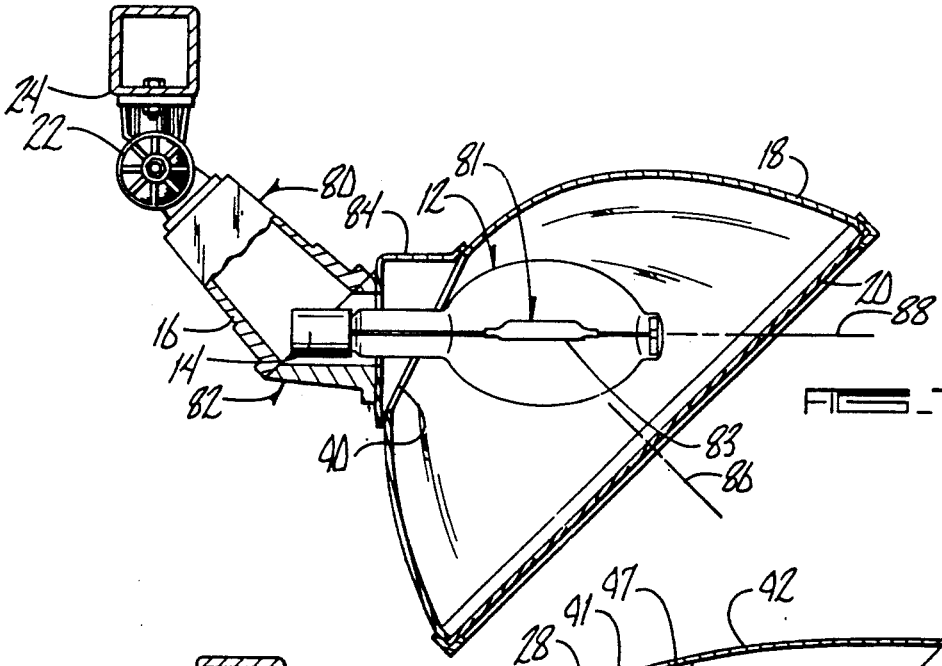

FIG. 7 is a side elevational view with portions in cross-section showing a generally conventional arc lamp in a modified light fixture according to another aspect of the present invention. FIG. 7 also depicts an optional embodiment of the arc tube of the arc lamp wherein at least a portion of the bottom of the arc tube is flattened.

Figure 8:
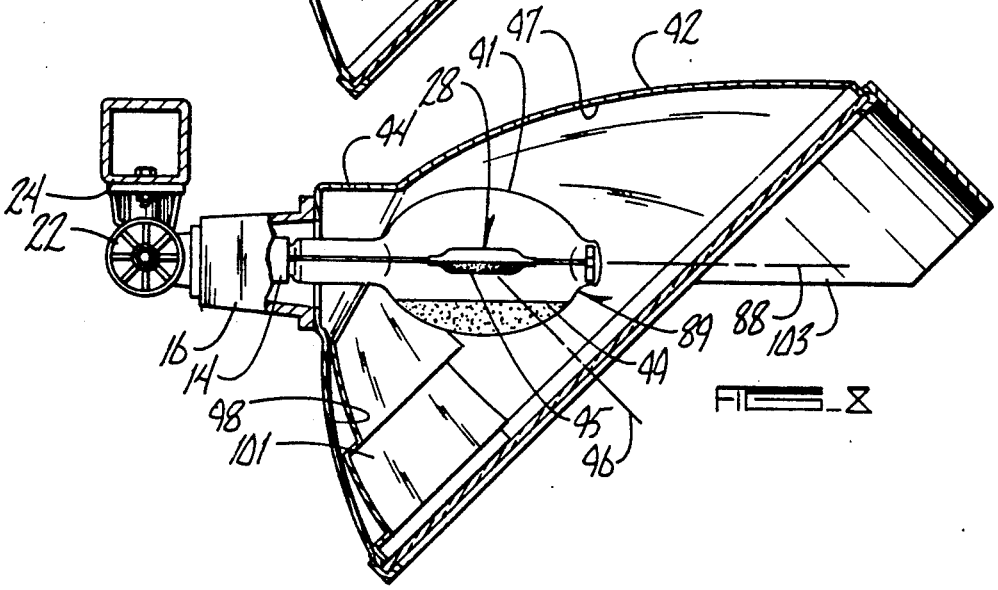

FIG. 8 is a side elevational view with portions in cross-section showing a generally conventional arc lamp positioned in an altered light fixture. FIG. 8 also depicts optional features and alternative embodiments for the fixture of an arc lamp; such as an altered reflector shape, a visor or hood, a reflector insert in the lower hemisphere of the reflector, coating on the bottom of the arc tube, and coating on the bottom portion of the bulb of the arc lamp.

Figure 9:
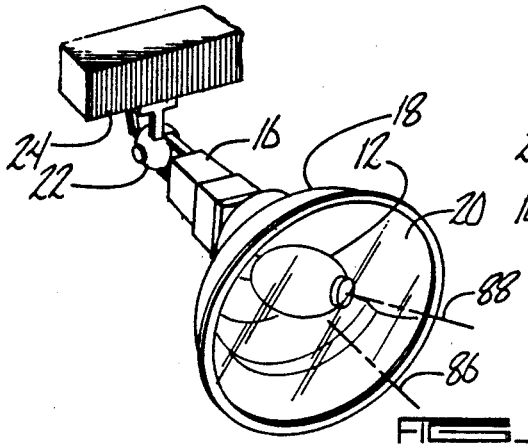

FIG. 9 is a perspective view of the combination shown in FIG. 7.

Figure 10:
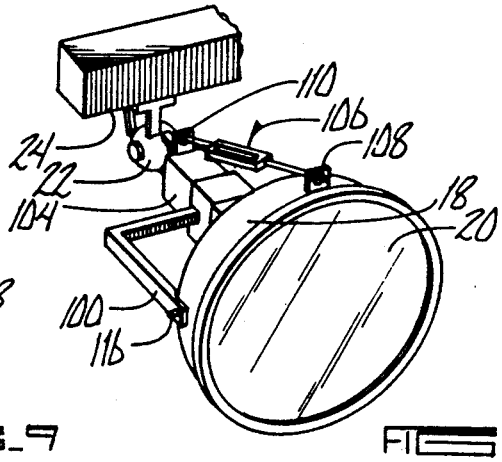

FIG. 10 is a perspective view of a still further embodiment of and aspect of the invention, including apparatus for tilting of the reflector according to desire.

Figure 11:
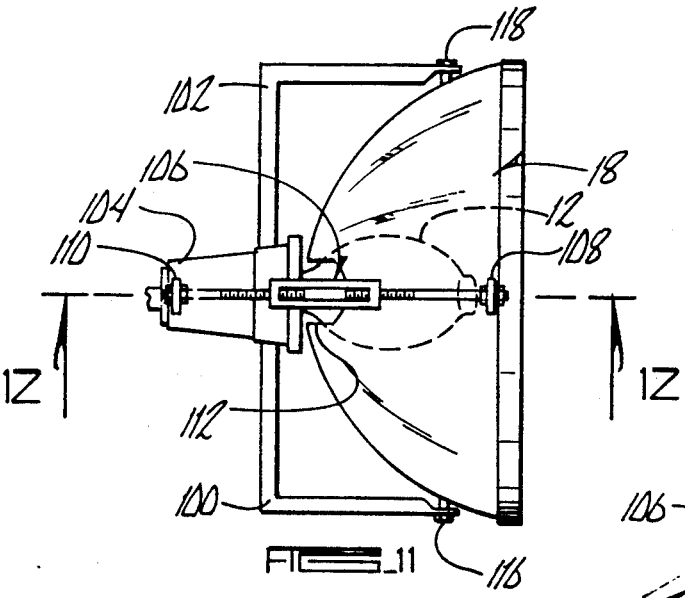

FIG. 11 is a top plan view of FIG. 10.

Figure 12:
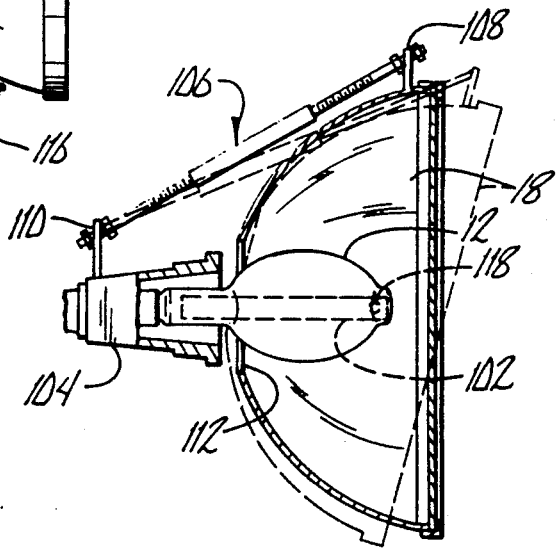

FIG. 12 is a sectional view taken along line 12—12 of FIG. 11, showing reflector pivoting in broken lines.

FIG. 13 is an isolated side elevational view of one embodiment of an alignment mounting means, showing a screw-in socket in cross-section, and the arc lamp detached from the socket.

FIG. 14 is a partial cross-sectional view of the embodiment of FIG. 13, showing the arc lamp inserted into the socket.

FIG. 15 is an isolated side elevational view of another embodiment of an alignment mounting means showing the threaded socket in cross-section, and the arc lamp detached therefrom.

FIG. 16 is a side elevational view of the embodiment of FIG. 15 showing in dashed lines the position of the threaded end of the arc lamp if totally inserted into the socket, which results in the arc tube being out of desired position (also shown in dashed lines). FIG. 16 shows in solid lines the arc lamp turned back outwardly from the position in dashed lines by sufficient rotation to achieve the correct orientation of the arc tube of the arc lamp.

Figure 17:
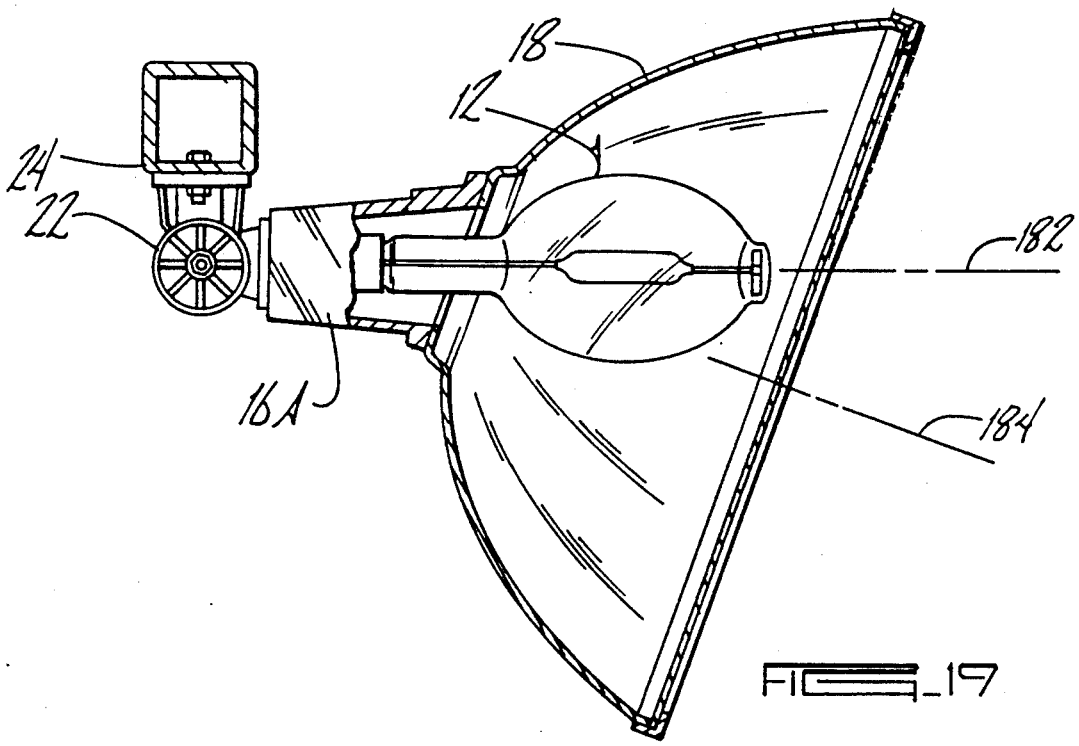

FIG. 17 is an enlarged partial perspective view of an alternative embodiment for an alignment mounting means for an arc lamp similar to that shown with respect to the arc lamps in FIGS. 15 and 16.

FIG. 18 is a still further enlarged partial elevational and cross-sectional view taken along line 18—18 of FIG. 17.

FIG. 19 is a side elevational view with portions in cross-section showing a conventional arc lamp in another embodiment of a modified light fixture.

Figure 20:
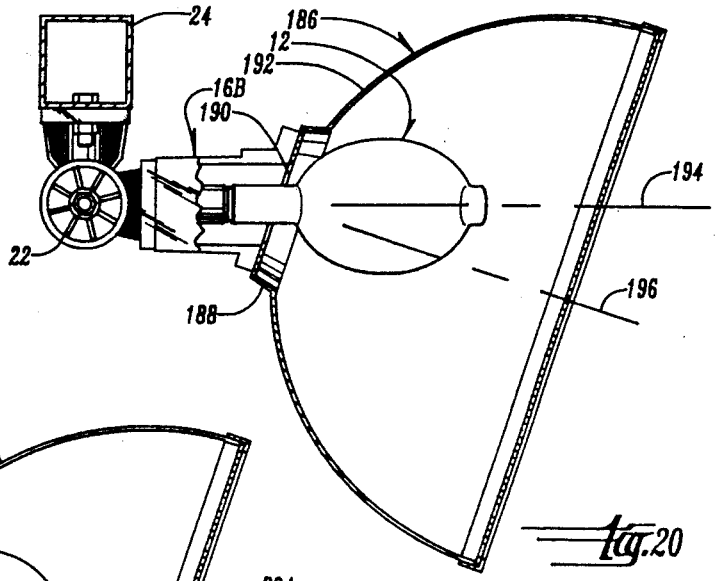

FIG. 20 is a side elevational view with portions in cross-section showing a conventional arc lamp in another embodiment of a modified light fixture.

Figure 21:
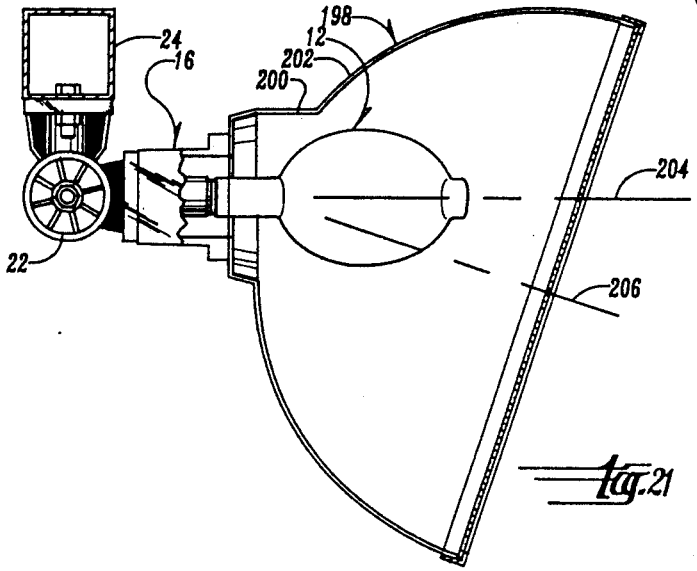

FIG. 21 is a side elevational view with portions in cross-section showing a conventional arc lamp in still another embodiment of a light fixture.

Figure 22:
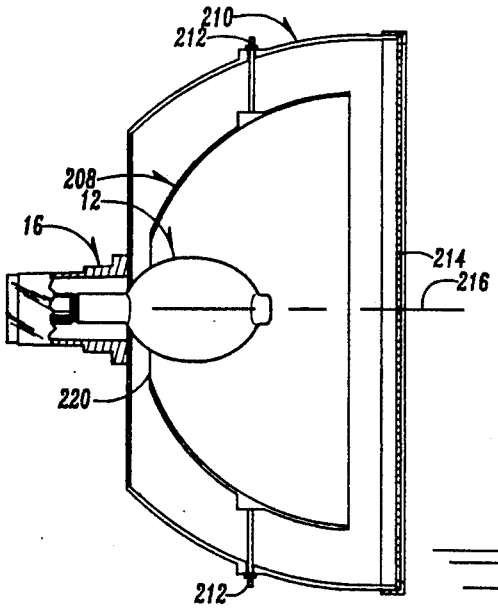

FIG. 22 is a top plan view with portions in cross-section of a conventional arc lamp in another embodiment of a modified light fixture, where the reflector can be pivoted with respect to the arc lamp according to desire.

Figure 23:
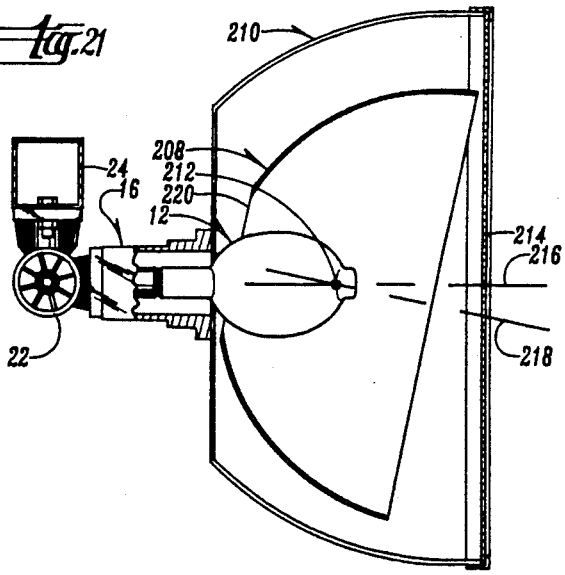

FIG. 23 is a side elevational view of FIG. 22 with portions in cross-section.

Figure 24:
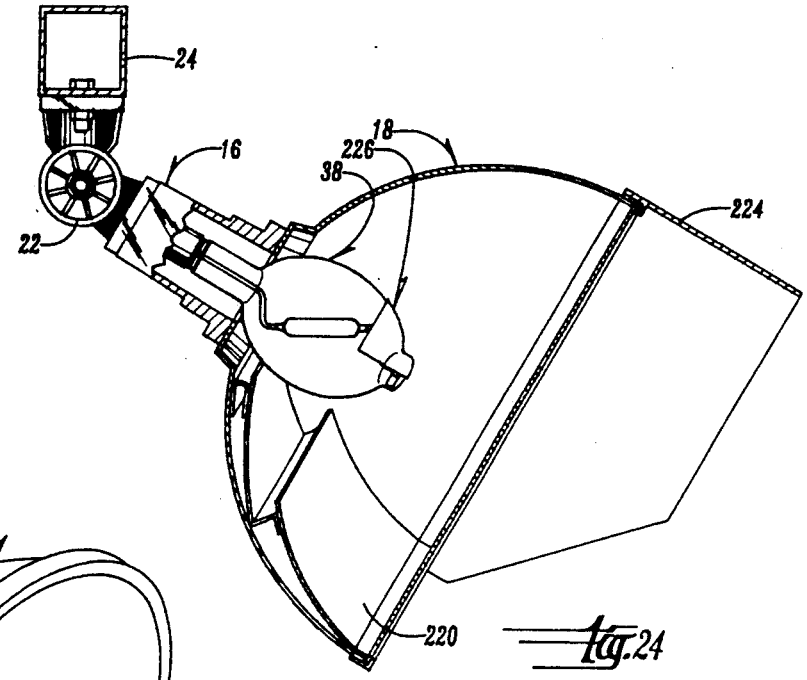

FIG. 24 is a side elevational view of an embodiment of a light fixture with portions in cross-section and an arc lamp with a tilted arc tube, a reflector insert, a reflector visor or hood, and an arc shield on the arc lamp.

Figure 25:
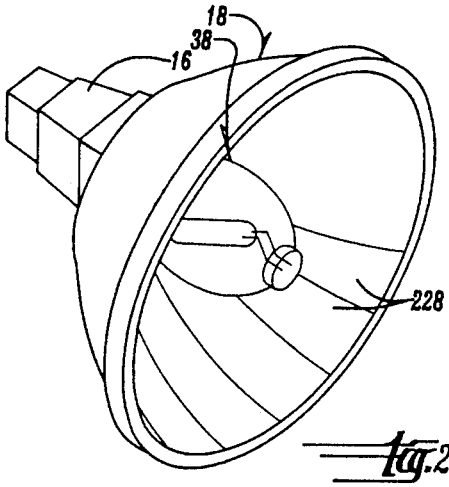

FIG. 25 is a partial perspective view of a reflector having an alternative embodiment for a reflector insert, and an arc lamp having a tilted and/or offset arc tube.

Figure 26:
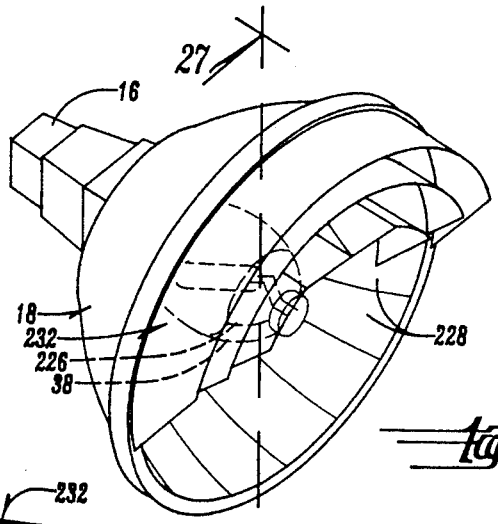

FIG. 26 is similar to FIG. 25 except it further includes a combination of reflector hoods or visors.

Figure 27:
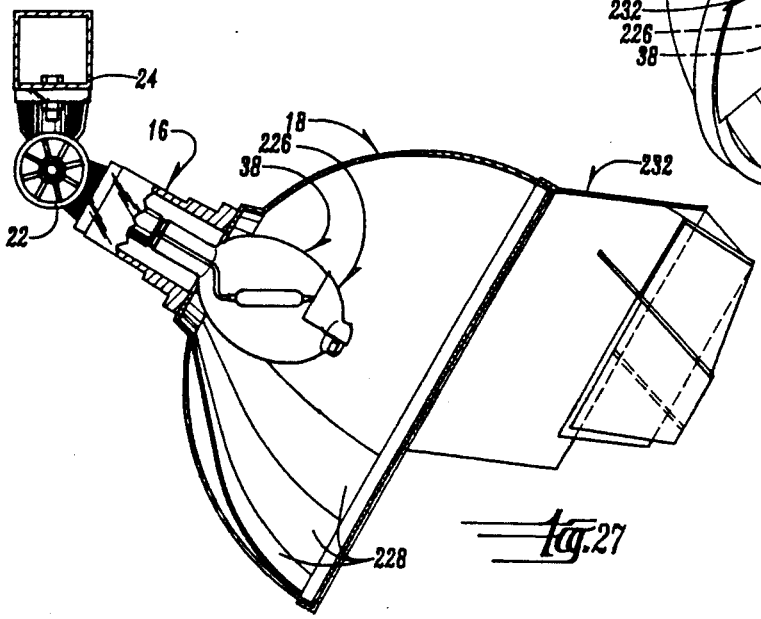

FIG. 27 is a cross-sectional side elevational view of FIG. 26.

DETAILED DESCRIPTION OF THE PREFERRED EMBODIMENT

With reference to the drawings, specific preferred embodiments of the present invention will now be described. It is to be understood that this description is for purposes of example only, and does not limit the scope of the invention, which is described solely by the claims which shall follow.

In the drawings, parts or elements will be referred to by reference numerals. Like parts in some figures will be referred to by like reference numerals.

Figure 1:
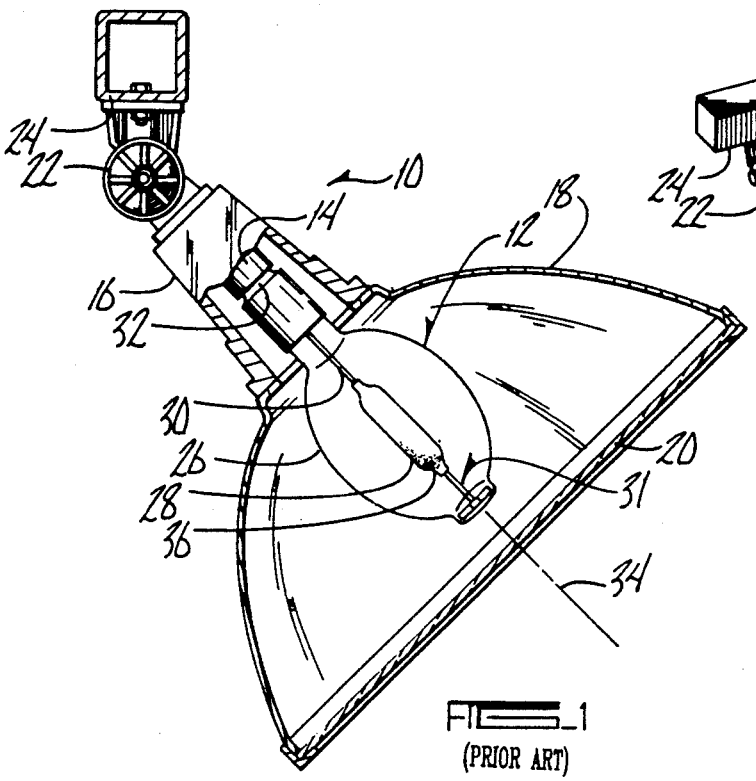
FIG. 1 (PRIOR ART)
FIG. 1 is a side elevational view, with portions in cross-section, of a conventional arc lamp positioned in a conventional symmetrical reflector and screw mount socket, which in turn is connected to an adjustable mounting means on a crossbar.
Figure 2:
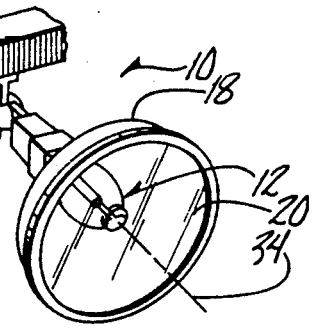
FIG. 2 (PRIOR ART)
FIG. 2 is a perspective view of the arc lamp and lighting fixture depicted in FIG. 1.

With particular reference to FIGS. 1 and 2, there is shown a conventional light fixture which will be referred to with reference numeral 10, which includes a conventional arc lamp 12 threadably mounted in a socket 14 which is in turn secured to bulb cone 16. A reflector 18 is also attached to bulb cone 16 and includes a lens 20. The bulb cone is adjustably attached to mounting bracket 22 which is adjustably positionable and mountable with respect to crossbar 24.

Conventional arc lamp 12 includes bulb 26 which encapsulates arc tube 28 and mounting and electrical connections 30 and 31. A threaded mount 32 (not shown) on the end of bulb 26 is threadably received into socket 14, and serves as the electrical interface between mounting and electrical connections 30 and 31 and an electrical power source which is in communication with bulb cone 16 (the electrical power source is not shown).

As can be seen, conventional arc lamp 12 is positioned centrally within reflector 18. Line 34 represents concurrently the aiming axis of fixture 10 (that is, the general axis about which light from fixture 10 is aimed to a target area), the general longitudinal axis of arc lamp 12, and the general longitudinal axis of arc tube 28. All three are coaxially aligned.

FIG. 2 shows in perspective the conventional fixture 10, and combined axis 34. Because lamp 12 is contained within reflector 18, a substantial portion of the light emanating from arc tube 28 radiates to and is captured and redirected by reflector 18 towards the target area (that is, if more of the side of arc tube 28 is exposed towards the target area). The light pattern of arc tube 28 is such that more light radiates perpendicularly from the longitudinal axis of the arc tube, than from its ends along the longitudinal axis. Therefore, the intensity of light emanating directly from the outer end of arc tube 28 along axis 34 to the target area is less than if arc tube 28 was tilted towards the target area (that is, if more of the side of arc tube 28 is exposed towards the target area). This also means that a significant amount of light needs to be captured by reflector 18 and redirected to the target area. There is always a loss of light when light is reflected. Therefore, in the configuration of FIGS. 1 and 2, light loss from reflection loss exists. Additionally, FIGS. 1 and 2 show a conventional orientation of a conventional fixture 10, namely, angled downwardly from support crossbar 24 somewhere between horizontal and vertically downward.

In this non-vertical, non-horizontal position, the tilt factor comes into effect for arc lamps, such as mercury and metal halide lamps. As schematically depicted in FIG. 1 by reference numeral 36, because the lower end of arc tube 28 (and particularly the bottom side of the lower end) is cooler than the upper end, some of the loaded chemicals in arc tube 28 precipitate out during operation which causes blockage and loss of light output from arc lamp 12.

Figure 3:
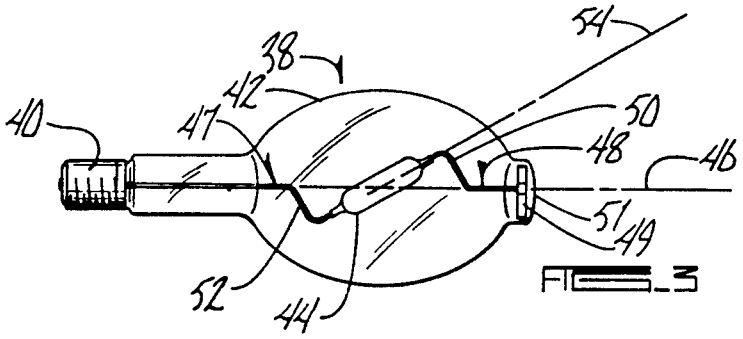
FIGS. 3–5 are side elevational views showing one aspect of the invention; namely, an arc tube which is tilted from the longitudinal axis of the arc lamp.
Figure 4:
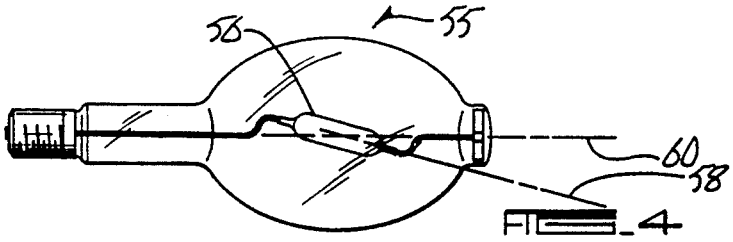

FIGS. 3–5 depict one aspect of the present invention. FIG. 3 depicts an arc lamp 38 having a threaded mount 40, a bulb 42, and an arc tube 44 enclosed within bulb 42. As can be seen, arc tube 44 is tilted with respect to longitudinal axis 46 of arc lamp 38. Mounting/electrical connection 48 has an angled portion 50 connected to one end of arc tube 44. Mounting/electrical connection 47 has an angled portion 52 connected to the other end of arc tube 44. Line 54 depicts the longitudinal axis of arc tube 44. Axis 54 is thus angularly pivoted and tilted along and with respect to axis 46.

FIG. 4 shows an arc lamp 55 with an arc tube 56 having a longitudinal axis 58 offset from arc lamp axis 60. It can be seen that arc tube 56 is tilted at a smaller angle than that shown in FIG. 3, and in an opposite direction.

By further example, FIG. 5 shows arc lamp 62 having arc tube 64 with longitudinal axis 66 tilted from axis 68 of lamp 62. In this embodiment, the tilt of arc tube 64 is greater than that shown in FIGS. 3 or 4.

It is to be understood that in the broadest sense, the arc tubes can be tilted from the longitudinal axis of the arc lamp in any direction and orientation. In some applications, it may be desired that the arc tube be tilted not only upwardly or downwardly with respect to the longitudinal axis and the front of the bulb, but also laterally, to obtain some sort of a directional orientation of the arc tube for a specific lighting or glare control effect. Additionally, the arc tube does not have to be pivoted or tilted on the longitudinal axis of the arc lamp. It can be simply offset in a tilted orientation to the lamp's axis. It could also be both tilted and offset. Further examples of tilted and/or offset arc tubes from the longitudinal axis of an arc lamp can be found at copending patent application by Gordin and Drost, DISCHARGE LAMP WITH OFFSET OR TILTED ARC TUBE, filed Oct. 10, 1989, Ser. No. 419,018, which is incorporated by reference herein.

If reduction of the tilt factor is a primary goal, in a non-vertical or non-horizontal aimed fixture, the arc tube could be pivoted and tilted from the longitudinal axis of the arc lamp (which would not be horizontal or vertical) so that it was in a horizontal or vertical, or at least generally horizontal or vertical position. Generally, the arc tube could be tilted in the vertical plane defined by the longitudinal axis of the arc lamp.

FIGS. 6A–12 show various embodiments for altering the orientation of an arc tube with respect to the longitudinal axis of either the arc lamp, or the aiming direction, or the general reflection axis of a reflector. As is shown in these Figures, tilting of the arc tube with respect to the aiming direction of the fixture can be accomplished in a number of ways. Fundamentally, the arc tube can either be tilted within the arc lamp, or the entire arc lamp can be mounted in a tilted position relative to the aiming axis of the reflector. FIGS. 6A-9 depict arc lamps and reflector assemblies in a manner so that the arc tube is in a generally horizontal or vertical position to reduce tilt factor. It is to be understood, however, that these basic concepts could also be utilized to hold the arc lamp in a configuration so that the arc tube is offset or oriented away from the aiming direction of the reflector (other than horizontally or vertically) to produce a different light pattern or achieve some glare control function, regardless of reducing tilt factor.

FIG. 6A utilizes arc lamp 38 of FIG. 3, threadably mounted into conventional socket 14 of conventional bulb cone 16. Conventional symmetrical, hemispherical reflector 18 is also utilized. As can be seen, longitudinal axis 54 of arc tube 44 is generally horizontal. However, line 70, which represents both the longitudinal axis of arc lamp 38, and the aiming direction or reflector axis of the entire fixture, is angularly offset from axis 54 downwardly to target area. It is to be understood that line 70 and axis 54 are generally in the same vertical plane. It can therefore be seen that the embodiment of FIG. 6A holds arc tube 44 in a generally horizontal position to minimize tilt factor, and yet utilizes a conventional mounting fixture and reflector to direct light to the target area.

It is to be further understood that the arrangement of FIG. 6A would allow easy retrofitting of existing fixtures. All that would be required would be to replace conventional arc lamps with arc lamp 38. Still further, arc lamps such as shown in FIGS. 3–5 could be manufactured so that different tilts or offsets of axis 54 of arc tube 44 of the lamp 38 to the desired downward angle of a fixture could be accommodated.

Still further, it is to be understood that in the embodiment of FIG. 6A, because significantly more light radiates laterally from the longitudinal axis 54 of lamp 38 than from its ends, a substantial amount of light would pass directly through lens 20 down to the target area. A substantial amount of light would also be captured and reflect off the top half 72 on the interior of reflector 18 down to the target area. More light output can then be directed to the target area.

With respect to a still further aspect of the invention, the lesser amount of light radiating directly from either end of arc tube 44 could reduce glare problems. The light emanating directly from end 74 of arc tube 44 along line 54 would not be of as great an amount and intensity as if arc tube 44 was aligned along line 70. Additionally, light from end 76 of arc tube 44 would be of a lesser quantity to be reflected from lower hemisphere 78 of the interior of reflector 18 than if arc tube 44 was aligned along axis 70. Thus, again, more light output could be directed to the target area, with less light and glare existing outside the target area.

It can therefore be appreciated that the embodiment of FIG. 6A contributes to the advantages of increased light output (efficacy from the lamp), increased efficiency at the target area, reduction in tilt factor, and glare and spill control. It is to be understood that the nature of the elongated arc tube 44 is such that most of the light emanates outwardly and radially along its longitudinal axis. Considerably less light emanates from the ends of the tube 44. Therefore, by tilting tube 44 off of the aiming axis of the lamp assembly, so that a greater part of its side is facing towards the target area, more direct, unreflected light from tube 44 is made available to be placed towards the target. Less reflected light needs to be relied on. Efficacy is therefore enhanced by actually contributing to deriving more useful light from the light fixture, while at the same time reducing the effects of the tilt factor.

It is to be understood that tilt factor can contribute up to 20% light loss. Additionally, utilizing direct light to the target area, rather than mostly reflected light, can contribute to a 7% increase of light to the target area. A reconfigured beam shape or pattern contributes 8%–18% gain, depending on what is utilized. The combined benefit of the configuration of FIG. 6A can result in as high as a 35%–45% gain in light output to the target area. At worst, and for varying conditions, it is estimated that a not less than 25% increase, as a norm, in light can be expected.

Because arc lamps are generally used for high intensity lighting, they require significant amounts of power. Additionally, they are relatively expensive. Thus, an increase in light output of such magnitude represents a significant advance which impacts both on efficacy and efficiency of the lights, and also on the economy of such lights with regard to the initial acquisition costs and savings on operating costs.

FIG. 6B is identical to FIG. 6A, except that it shows that arc lamp 38 can also be threadably screwed into socket 14 so that the ultimate operating position of arc tube 44 is generally vertical, instead of horizontal as shown in FIG. 6A. Because arc lamp 38 can be threaded axially in and out along axis 70, the ultimate orientation of arc tube 44 can be varied. As has been previously explained, tilt factor can be reduced by either operating the arc tube in a generally horizontal or generally vertical position. It is again emphasized, however, that it may be desired to orient arc tube 44 in other than vertical or horizontal positions, and in other than in a vertical plane. It is to be understood that the present invention works equally as well with other types of mounts for arc lamps. One example of another type of mount is a plug-in mount.

FIG. 7 represents an alternative manner in which to achieve the objects of the embodiment of FIG. 6. A conventional arc lamp 12 (with arc tube 81 aligned along the longitudinal axis of arc lamp 12) is screwably mounted into a mounting fixture 80 having a socket 14, a bulb cone 16, and an angled extension 82. A complementary portion 84 extends from conventional reflector 18, and mates with angle extension 82. The combination of complementary portion 84 and angled extension 82 allows mounting fixture 80 to be offset from aiming axis 86 of reflector 18 to allow the entire conventional lamp 12 to be positioned horizontally along longitudinal axis 88. As in FIG. 6A, the advantages of such a position would be achieved. In this case, however, extension 82 and portion 84 are added, along with a new aperture 90 in the lower hemisphere of reflector 18 so that a conventional arc lamp 12 can be utilized instead of the lamp 38 with the tilted arc 44 in FIG. 6. In other words, aperture 90 in FIG. 7 is moved along the hemispherical reflector downwardly so that the arc lamp 12 can be inserted into reflector 18 so that arc tube 81 is somewhat centered within reflector 18. The angles for parts 82 and 84 can be as desired, and can vary from what is shown in FIG. 7. It is to be understood, however, that this embodiment could also be used with a conventional reflector 18 with its original centered aperture. This would allow easy retrofitting on to existing fixtures. This would, of course, mean that arc lamp 12 and arc tube 81 may not be exactly centered within reflector 18. This may be acceptable, however, according to certain uses.

FIG. 7 also depicts an option with respect to arc tube 81 which can be utilized if desired. Arc tube 81 of FIG. 7 is similar to arc tube 28 of arc lamp 12 of FIG. 1 except that its bottom portion 83 is flattened towards the longitudinal axis 88 of the arc tube. The purpose for such flattening is to attempt to raise the temperature of the bottom of arc tube 81 by moving bottom portion 83 closer to the arc, to hopefully reduce any temperature differences between the bottom and top parts of arc tube 81. This would further serve to reduce any precipitation of the chemicals inside the arc tube caused by temperature differences between the hotter upper side of the arc tube and the cooler lower side. It is to be understood that flat portion 83 may extend along the entire length of arc tube 81, or only for a portion thereof. For example, the flattened portion 83 could extend only for a small distance from the front of the arc tube towards the middle of the arc tube. Other configurations are possible. Furthermore, flattened arc tube 81 could be used with any of the embodiments disclosed herein.

FIG. 8 shows a still further embodiment utilizing an arc lamp 89, a conventional bulb cone 16 and socket 14. Arc tube 28 is aligned along the longitudinal axis of lamp 89. In this case, reflector 92 itself is modified so that angled mounting portion 94 extends from the back of reflector 92 to where it can be mounted to bulb cone 16. Portion 94 is offset from aiming axis 96, but allows alignment of arc lamp 89 and arc tube 28 along axis 88, in a horizontal position and so that arc tube 28 is generally photometrically centered inside reflector 92.

FIG. 8 also shows some optional features and alternative embodiments which could be used with the fixture shown in FIG. 8, or with any of the embodiments disclosed herein. The bulb 91 of arc lamp 89 of FIG. 8 could have a coating 99 applied to its bottom portion either on the inside or outside. Similar to flattened arc tube 81 of FIG. 7, coating 99 on bulb 91 would attempt to heat up the lower portion of arc tube 28 to reduce temperature differences between the top and bottom of the arc tube. The coating 99 could extend across bulb 91, or only for a portion thereof.

Still further in FIG. 8, a coating 95 could be applied to the bottom of arc tube 28 itself. Coating 95 would also attempt to heat up the lower portion of arc tube 28 to reduce any temperature differences between the top half and the bottom half. Coating 95 could be a separate piece applied to the arc tube, but is preferably a material that can be coated directly on the arc tube 28, and therefore needs to be highly resistant to high temperature. In the preferred embodiment, coating 95 (as well as coating 99) could be a white aluminum oxide material.

These coatings could serve to block heat from escaping the lower end of the tube and to contain heat energy into the lower half of arc tube 28. It is to be understood that coating 95 and 99 could also serve to reflect light from arc tube 28 to the upper hemisphere 97 of reflector 92 so that light may be captured and directed to the target area. This could assist in reducing glare caused by light striking the lower hemisphere 98 of reflector 92, and reflecting upwardly and outwardly away from the target area.

It is further to be understood that reflector 92 could be configured so that upper hemisphere 97 is not symmetrical to lower hemisphere 98. Reflector 92 has to be customized for the special mounting of arc lamp 91. The upper hemisphere 97 could also be made to be of a desired shape for desired reflecting properties. This could include extending the outward lip of upper hemisphere 97 farther out than a conventional symmetrical reflector, to serve as a sort of visor or hood to capture more light and reflect it to the target area. Other shapes, configurations, and lighting characteristics can be accomplished.

Furthermore, lower hemisphere 98 could be altered to achieve a desired reflecting property. For example, a conventional symmetric reflector may have a lower hemisphere which is converging. This would cause light to be directed upwardly and outwardly away from the target area. The lower hemisphere 98 could be modified to have diverging properties to solve this problem. Additionally, some sort of a reflector insert 101 could be added to the lower hemisphere 98 to achieve specialized reflecting properties. It is to be understood, that if coating 95 is utilized, reflector insert 101 may be unnecessary.

Furthermore, a reflector hood or visor 103 can optionally be utilized with any of the embodiments. Hood 103 would serve to capture outwardly and upwardly emanating light and redirect it to the target area. It is to be understood that tilted or offset arc tubes, such as shown in FIGS. 6A and B, may function to remove the need for any such reflector hood 103. It is to be understood that tilted and/or offset arc tubes can minimize or reduce the need for reflector hoods or visors, or other reflection modifying devices, but in certain applications the use of the tilted end or offset arc tubes with these devices can enhance the lighting pattern desired as well as glare and spill control.

FIG. 9 shows in perspective view the embodiment shown in FIG. 7. It is to be understood that the invention also could be utilized to position lamp 12 off center in reflector 18 if desired. Additionally, tilting of lamp 12 with respect to the aiming axis 86 of reflector 18 could be in any direction, if desired. Additionally, an arc lamp 38 with an offset or tilted arc tube 44 (such as in FIG. 3) could be utilized in any of these fixtures if desired. FIG. 9 therefore shows how an entire fixture, having an aiming axis 86 directed angularly downward, can utilize a conventional arc lamp where the arc lamp and arc tube have a longitudinal axis shown at 88. The fixture allows the arc lamp to be positioned in a generally horizontal orientation during operation, yet lets it take advantage of the reflecting properties of reflector 18. This is one way of combatting tilt factor. It is to be understood, however, that different orientations of arc lamp 12 could be used if desired, including configuring the fixture so that the arc lamp is oriented in a generally vertical position. Still further, as mentioned before, arc lamps with offset and/or tilted arc tubes can also be used.

FIGS. 10–12 show a still further embodiment according to one aspect of the invention. In FIG. 10, a conventional reflector 18 with a lens 20 would be pivotally mounted at opposite lateral sides in arms 100 and 102 (see FIG. 11), which would extend back to bulb cone 104. An adjustment device 106, such as a turnbuckle, could be hingeably, pivotally, or flexibly connected between mount 108 on reflector 18, and mount 110 on bulb cone 104 by means within the skill of those skilled in the art. As shown in FIGS. 11 and 12, a slot 112 could be cut in the back of reflector 18. Conventional arc lamp 12 (or any arc lamp disclosed herein) could be threadably mounted into a socket in bulb cone 104. By lengthening or shortening adjustment device 106 (a turnbuckle in FIGS. 10–12), reflector 18 would pivot about pins 116 and 118. Slot 112 would allow such movement without interference with arc lamp 12. This arrangement would thus allow either the conventional configuration of arc lamp 12 and reflector 18 as shown in FIG. 12, where the longitudinal axis of arc lamp 12 and the aiming axis of reflector 18 are coaxial, or allow tilting of reflector 18 with respect to arc lamp 12 to accomplish at least some of the advantages of the embodiments shown in FIGS. 6A–8.

The configuration of FIGS. 10–12 would be beneficial where the aiming angle of reflector 18 is not known in advance, or if it changes from time to time. Furthermore, it would be useful where different lighting effects are desired from time to time. As can be seen in FIG. 12, the tilting of reflector 18 is shown in broken lines and depicts how the aiming axis of the reflector can be altered while leaving the arc lamp in a set position.

FIGS. 13–18 depict different embodiments for achieving desired alignment of an arc lamp within a socket. As can easily be appreciated, when an arc tube in an arc lamp is offset from the longitudinal axis of the arc lamp, and when the arc lamp has a threadable mount such as shown in FIGS. 13–18, the ultimate orientation of the arc tube depends on how the lamp ends up after it is rotated into socket 128. Electrical contact must be made between the very end of the threaded portion of arc lamp 120, and the electrical connection in the socket 128. Because economically available threadable mounts cannot be made uniform, assurance that the ultimate position of an arc tube 122 and an arc lamp 120 will end up in the same position from fixture to fixture is not possible.

FIGS. 13–18 therefore show structure for assisting in allowing control over the ultimate orientation of arc tubes when positioned in a threadable socket. These embodiments are especially useful in instances where an arc lamp is utilized with the arc tube being tilted or offset from the longitudinal axis of the arc lamp. It is desirable that the arc lamps be able to be mass-produced, and at the same time, there be assurance that when mounted within a conventional socket, the orientation of the arc tube within the arc lamp will end up as desired, regardless of which socket is being utilized.

By referring to FIGS. 13 and 14, it can be seen that arc lamp 120 includes an arc tube 122 offset from the longitudinal axis of arc lamp 120. The threaded end 124 of arc lamp 120 includes a pin 126 extending basically perpendicularly from the longitudinal axis of the arc lamp at the threaded end 124. Socket 128 is conventional having threads 130 to receive threaded end 124 of lamp 120. Additionally, in some sockets, a small spring 132 with flat member 134 attached to its end, is positioned in the inner end of socket 128. Spring 132 and flat member 134 serve to provide an electrical connection between one electrode of the arc lamp 120 and electrical power supply, and also may serve to provide a slight outwardly biasing force against arc lamp 120 to help in retaining it within socket 128.

Socket 128 does contain one modification. A short oblique slot 136 is formed near the front edge 138 of socket 128 defining the opening into the threaded socket portion of socket 128. Slot 136 serves to receive pin 126 as lamp 120 is threadably mounted within socket 128. Slot 136 thus serves as a stop to prevent further rotation of lamp 120, and also to retain pin 126. By placing slot 136 appropriately, and by doing the same with pin 126 on lamp 120, the desired rotational alignment of lamp 120 and socket 128 can be accomplished.

For example, if arc tube 122 is desired to be always positioned as shown in FIG. 13 upon mounting in socket 128, the location of slot 136, and pin 126 can be determined so that this always occurs.

FIG. 14 depicts lamp 120 mounted within socket 128. Pin 126 is shown received into slot 136. All appropriate electrical connections are made to allow the lamp 120 to operate.

FIGS. 15 and 16 show an alternative embodiment for allowing alignment of an arc lamp. An arc lamp 140, having an arc tube 142 with its axis offset or tilted from the axis of lamp 140, includes a conically shaped spring 144 secured to end 146 of threaded end 148 of arc lamp 140. A conventional socket 150 includes threads 152 to receive threaded end 148 of lamp 140, and also can include spring 154 and flat member 156, which are the same as spring 132 and flat member 134 of FIGS. 13 and 14.

Conically shaped spring 144 in the preferred embodiment is made from a beryllium-copper alloy and is configured so that when compressed, it folds down substantially flat upon itself. The spring 144 should be stout, resilient, and made from a conducting material. It also should be able to withstand very high temperatures and be non-corrosive.

Because of differences in orientation of each socket 150 and its threads 152, from socket to socket, and because of a similar difference in the placement of the threads on threaded end 148 of arc lamp 140 from arc lamp to arc lamp, the exact rotational orientation of lamp 140 when completely threaded into socket 150 cannot be predicted from socket to socket, or from lamp to lamp. Thus, this embodiment allows arc lamp 140 to be threaded into any socket 150.

It is to be understood that spring 144 also insures that electrical connection between the arc lamp 140 and the socket 150 will be made at variable points along the longitudinal axis of socket 150. Spring 144 can be compressed as little or as much as needed to accomplish the correct rotation of lamp 140 to achieve the desired orientation of arc tube 142. Spring 144 needs to be long enough to maintain electrical connection over at least one full rotation of arc lamp 140. This will allow any desired orientation for arc tube 142.

It is to be further understood that some sockets 150 do not include spring 154 and washer 156. Moreover, some existing sockets 150 which do have spring and washer 154, 156, are in such a shape that spring 154 is permanently compressed and therefore does not assist in any significant way to maintaining electrical contact at various positions of lamp 144 in socket 150. Spring 154 does not generally have sufficient length to maintain electrical connection over one complete rotation of arc lamp 140. Therefore, spring 144 is critical to this purpose, and can accomplish the above stated functions regardless of the existence or state of spring 154 and washer 156.

As shown by dashed lines in FIG. 16, end 146 of threaded end 148 of arc lamp 140 would first be threaded into socket 150 until it cannot be threaded inwardly any more. Conically shaped spring 144 would thus be significantly compressed against spring 154 and flat member 156 and would compress spring 154.

As also shown in dotted lines in FIG. 16, most often arc tube 142 will be in an undesired rotational position when arc lamp 140 is fully turned down into socket 150. Therefore, as shown in solid lines in FIG. 16, arc lamp 140 would then only need to be turned back out sufficiently so that arc tube 142 is rotated to the desired position (as shown by arc tube 142 in solid lines). This, of course, requires only less than a one full revolution backwards to correct any initial misalignment.

Conically shaped spring 144 would maintain the electrical contact between end 146 of lamp 140 and the electrical power source through spring 154 and flat member 156 through at least 360° of rotation. Because spring 144 is stout, it would provide sufficient biasing force back against lamp 140 and contribute to holding it in place through normal operational use.

It is to be understood that the spring 144 of FIGS. 15 and 16 is needed because in cases where socket 150 includes a spring 154, such spring is generally on the order of ⅛" long. Therefore, the amount of rotation needed to insure correct positioning of arc tube 142 requires the flexible extension distance of spring 144. Spring 144 is also many times needed for sockets 150 that do not include a spring 154, or where spring 154 is collapsed or compressed from previous use or for other reasons.

FIG. 17 shows in perspective format an alternative spring **144*a* which can be attached to threaded end 148 of a lamp 140, such as shown in FIGS. 15 and 16. In this embodiment, spring 144*a* functions like conically shaped spring 144 of FIGS. 15 and 16. It differs somewhat in structure by being composed of a conical flat wire spring having a pin 157 (having a rounded or hemispherical head) which can be mounted in the outer end 159 of spring 144*a*. Pin 157, in the preferred embodiment depicted, can be press fitted into spring 144*a***. Other mounting methods are possible.

Spring **144*a* would then function like spring 144 of FIGS. 15 and 16, having the property of being able to collapse completely onto itself, while additionally, the makeup of flat wire spring 144*a* allows the continuous sidewall of spring 144*a* to have what will be called side rigidity which assists in maintaining the operation of the spring, and presenting a reliable spring for operation according to the invention. The addition of the pin 157 with its rounded head, also assists in achieving a good electrical contact with spring 154 and flat member 156 of socket 150**, without potential for catching or otherwise malfunctioning.

FIG. 17, and FIG. 18 in more particular, show structure for mounting spring **144*a* to threaded end 148 of the arc lamp. One way to mount a spring such as 144 or 144*a* would be to solder it to the metal threaded end 148. However, the composition of some springs, including those preferred with the present invention (Beryllium-Copper), resists or does not take well to soldering. As shown in FIGS. 17 and 18, therefore, instead of soldering, four L-shaped tabs 180 are soldered to threaded end 148, and extend axially outward from threaded end 148. Spring 144*a* is placed within tabs 180. The outermost ends of tabs 180 are then bent over the walls of spring 144*a* to hold it in place. Tabs 180** can be made of brass which solders well and has good conductivity. They are also malleable enough to be bent as described.

FIG. 19 shows an additional embodiment of a fixture which can be used according to the present invention. The advantages of this fixture is that a standard, conventional reflector and arc lamp can be used. A conventional symmetrical spherical reflector 18 can be utilized. A conventional arc lamp 12 with arc tube aligned along the longitudinal axis of the arc lamp can be utilized. The only structural difference from a conventional fixture is that bulb cone 16*a* is modified so that it has an angled mounting junction with reflector 18. As shown in FIG. 19, this allows a conventional reflector 18 to be attached at a tilted orientation. The arc tube of arc lamp 12 can then be maintained in a horizontal orientation, but the aiming direction of reflector 18 can be down to the target area. This configuration is structurally simple, economical, and requires little modification of existing components.

FIG. 20 is similar to FIG. 19 in that it depicts the lighting fixture utilizing a conventional arc lamp 12 where the arc tube is coaxial with the longitudinal axis 194 of arc lamp 12. In this embodiment, however, socket 16B is conventional except that it has a front edge 90 which is angled to match a mounting rim 188 on reflector 186. It is to be understood that mounting rim 188 defines an aperture through reflector 186 which is formed off of longitudinal axis 196 of reflector 186. This can be accomplished during manufacture of reflector 186. Such a configuration allows the arc tube in lamp 12 to intersect and be approximately centered along axis 196 so that it is positioned along what can be called the photometric center of reflector 186.

To further understand this point, FIG. 20 shows that longitudinal axis 196 of reflector 186 intersects at point 192 in the rear of reflector 186. The opening through which lamp 12 is inserted into reflector 186 is below point 192. In comparison, it can be seen in FIG. 19 that the arc tube in arc lamp 12 which has a longitudinal axis 182 does not necessarily intersect with the longitudinal axis or aiming axis 184 of reflector 18. The embodiment of FIG. 19 may be desired in some cases whereas the embodiment of FIG. 20 may be desired in other cases. The advantage of the embodiment of FIG. 19 is that a conventional reflector 18 with the opening in its back centered along axis 184 can be used. In the embodiment of FIG. 20, both the modified bulb cone 16B and the modified reflector 186 must be utilized.

FIG. 21 is similar to FIGS. 19 and 20 with the following differences. A conventional bulb cone 16, without an angled front edge can be utilized. Reflector 198, having a longitudinal aiming axis 206, like the embodiment of FIG. 20, is modified so that its mount 200 defining the opening into reflector 198 for bulb 12 is positioned below point 202, the intersection of axis 206 at the rear of reflector 198. Again, this allows the arc tube of arc lamp 12, positioned along lamp axis 204, to intersect with axis 206 of reflector 198. It will be noted that in this particular embodiment, the mounting rim 200 must be built up on the top side to accommodate this configuration. This allows existing bulb cones or sockets 16 attached to light bar 24 by existing elbow members 22 to be fitted with reflector 198 to achieve desired lighting effects. Again, standard arc lamp 12 can be utilized.

FIGS. 22 and 23 show an alternative embodiment for allowing a standard arc lamp 12 to be utilized with a standard bulb cone or socket 116, in combination with a reflector which can be adjusted or tilted according to desire. Like the embodiment shown in FIGS. 10–12, the embodiment of FIGS. 22 and 23 utilizes a reflector 208 which is hingeably tiltable with respect to arc lamp 12. In this embodiment, a shroud 210 rigidly mounted to socket 16 completely encloses hinged reflector 208. A lense 214 covers the open end of shroud 210. Hinge pins 212 are mounted on opposite sides of shroud 210 and connect to reflector 208 to define a pivot axis. It is noted that like the embodiment of FIGS. 10–12, a slot 220 exists in the back of reflector 208 to allow the hinging action within shroud 210 with respect to lamp 12.

As shown at FIG. 23, the aiming or longitudinal axis 218 of reflector 208 can then be tilted with respect to the longitudinal axis 216 of arc lamp 12. Hinge pins 212 can contain locking mechanisms (such as are known to those skilled in the art) to hold reflector 208 in a desired position. Shroud 210 protects reflector 208 from wind and other disturbances. Such a fixture allows easy adjustment of aiming axis 218 with respect to axis 216 of lamp 12.

FIG. 24 shows an embodiment according to the present invention whereby a tilted arc lamp 38 is utilized in combination with the conventional bulb cone or socket 16 and conventional hemispherical reflector 18. Such a configuration is similar to that shown in FIG. 6A except that to alter the beam pattern emanating from the fixture, additional elements can be utilized. For example, a reflector insert 220 can be added in the interior of reflector 18. A reflector visor or hood 224 can be added to extend from the outer edge of reflector 18. Also an arc shield 226 can be positioned on arc lamp 38 as shown.

A more detailed description of these added parts 220, 224 and 226 can be found at Gordin, Glare Control Lamp and Reflector Assembly and Method for Glare Control, U.S. Pat. No. 4,725,934, co-owned with the owner of the present application and incorporated by reference herein.

As can be understood, the utilization of arc lamp 38 with the additional elements 220, 224 and 226 can combat tilt factor, mitigate glare and/or spill light problems, and can facilitate a beam pattern which puts more light to the target area or accomplishes special and desired light characteristics. The arc lamp 38, insert 220, visor 224, and arc shield 226 can all be easily retrofitted to existing fixtures. Most importantly, any one of those elements 38, 220, 224, and 226, any combination of them, or all of them can be used according to desire.

FIG. 25 shows in perspective a conventional spherical symmetrical reflector 18 with an arc lamp 38 having a tilted arc tube being mounted therein. In this embodiment, a reflector insert 228 is utilized in the bottom of reflector 18 to accomplish a function similar to that of reflector insert 220 in FIG. 24. Reflector insert 228 differs, however, in that it is made up of a plurality of strips of reflective material which are positioned between the rear center of the reflector and the outer edge of the reflector. These strips basically fill up the lower half of the inside of reflector 38 and are configured so that they alter the reflecting properties of that lower half of reflector 38. For example, the strips can be configured so that they change reflecting properties of the lower half of reflector 38 to direct more light downwardly to a target area to increase efficiency of the fixture. This would mean, in some cases, that reflector insert 228 would change the lower half of reflector 38 from a converging reflective surface to a diverging reflective surface. It is to be understood, however, that other reflecting properties can be accomplished. The reflector insert 228 can also be located differently and over different portions of the interior of reflector 38.

It is further to be understood that additional elements could be added to the embodiment of FIG. 25, for example, reflector visors or hoods, arc lamps and shields, or arc lamps with different tilts or offsets for the arc tube.

FIG. 26 is similar to FIG. 25 in that it utilizes reflector insert 228 along with tilted arc lamp 38. However, FIG. 26 specifically shows utilization of an arc shield 226 on the end of arc lamp 38 as well as combination reflector hood 232. As with FIG. 24, this combination would produce specialized changes in the light beam pattern which can again impact tilt factor, glare and spill control, and efficiency of the fixture in terms of improvement of the amount of light directed to the target area. For a more detailed description of reflector hood 232 and its possible combination with arc shield 226 and reflector inserts such as 228, reference is taken to co-pending U.S. patent application Ser. No. 308,750, inventors Gordin and Drost, filed Feb. 10, 1989, which is incorporated herein by reference.

FIG. 27 is a side partial cross-sectional elevational view of the embodiment of FIG. 26, showing the connection of parts of visor 232, tilted arc lamp 38, arc shield 226, and reflector 228. It is again emphasized that any one of these elements can be utilized to accomplish desired lighting functions, or any combination of two or more, according to desire.

It can therefore be seen that the invention achieves at least all of its stated objectives. It will be appreciated that the present invention can take many forms and embodiments. The true essence and spirit of this invention are defined in the appended claims, and it is not intended that the embodiments of the invention presented herein should limit the scope thereof.

For example, a variety of different orientations and configurations for arc lamps, reflectors, and overall fixtures can be utilized according to the needs for particular lighting applications. Arc lamps with offset and/or tilted arc tubes, oriented to predetermined positions and desired directions, can be utilized in modified fixtures according to the present application, or retrofitted into conventional fixtures. Additionally, standard arc lamps can be used in the modified fixtures according to the present invention for desired lighting purposes.

Additionally, it is to be understood that different arc lamps and/or fixtures can be used in the same array of light fixtures, if desired, to provide specialized lighting results. Different features set forth according to the present application therefore can be used singly or in combination as desired.

It is furthermore to be understood that arc lamps having arc tubes which are offset or tilted from the longitudinal axis of the arc lamp, according to the present invention, can take on any number of different orientations. Arc lamps having arc tubes which are offset or tilted are disclosed in commonly owned co-pending application Ser. No. 419,018, inventors Myron K. Gordin and James L. Drost, entitled DISCHARGE LAMP WITH OFFSET OR TILTED ARC TUBE, filed Oct. 10, 1989, referenced earlier.

What is claimed is:

1. A lighting fixture having socket means to which is mountable an arc lamp having a longitudinal axis which is coaxial with longitudinal axis of an arc tube in the arc lamp, the arc tube having an equator generally midway along the arc tube and generally perpendicular to the longitudinal axis of the arc tube comprising:

mounting means for mounting the socket means to a support; reflector means mountable to the socket means; and the reflector means having an open face and having an aiming axis extending generally from the middle of the reflector along a central axis which is not coaxial with the axes of the arc tube and arc lamp, the reflector means oriented, however, to surround a substantial majority of the equator of the arc tube to capture and reflectively control, a substantial majority of the light emanating from the arc tube the longitudinal axis of the arc tube diverging from the aiming axis of the reflector means but always extending in one direction out of the open face of the reflector means, wherein the longitudinal axis of the arc tube being oriented in a substantially horizontal position during operation of the arc lamp although the axis of the reflector is tilted between 10 and 60 degrees below horizontal so that the reflector maintains capture and control of the light source for a controlled, concentrated beam, but maintains the arc tube substantially horizontally to reduce or eliminate loss of light output from the arc tube caused by tilt factor and to control and reshape the beam configuration.

2. An arc lamp and generally symmetrical bowl or dish shaped reflector having an apex, a general focal point, and an axis extending through the apex and general focal point and being comprised of one or more segments including, but not limited to paraboloid, ellipsoid, hyperboloid, and spheroid segments for reducing loss of light caused by tilt factor and controlling light to a target area a substantial distance from the arc lamp comprising:

an arc tube having a longitudinal axis and an equator generally midway along and perpendicular to the longitudinal axis of the arc tube, the arc tube capable of producing a light source of several inches in length along the longitudinal axis of the arc tube, said light source emanating substantially outwardly in the direction of the equator of the arc tube;

electrical connections to the arc tube;

a bulb surrounding the arc tube and electrical connections;

a first mounting connection means associated with the bulb to mount the bulb in relation to the reflector, the first mounting connection means when mounted being positioned at or near the apex of the reflector so that the reflector captures a substantial amount of the light source around the equator of the arc tube;

a second mounting connection means associated to receive the first mounting connection means and for mounting the reflector and bulb to a support means; and the longitudinal axis of the arc tube being oriented in a generally horizontal position during operation of the arc lamp although the axis of the reflector is tilted between 10° and 60° below horizontal so that the reflector maintains capture and control of the light source for a controlled, concentrated beam, but maintains the arc tube generally horizontally to reduce or eliminate loss of light output from the arc tube caused by tilt factor and to control and reshape the beam configuration.

3. The means of claim 2 wherein an aiming direction for the reflector is offset in a vertical plane from the longitudinal axis of the arc tube, which is generally coaxial with the longitudinal axis of the arc lamp.

4. A lighting fixture means for capturing and controlling a substantial majority of light from an arc tube to provide a very concentrated beam at relatively high candlepower to a substantially distant target area comprising:

arc lamp means having an arc tube and a threaded end, the arc tube being elongated along a longitudinal axis and generating a majority of light outwardly from around its equator;

socket means having a threaded mount for receiving the threaded end of the arc lamp means;

a bowl or dish shaped reflector means having an open face and attachable to the socket means for substantially surrounding the equator of the arc tube to capture and reflectively control a majority of the light emanating from the arc tube the reflector means being of a basically symmetrical rotated shape of the spheroid, paraboloid, ellipsoid type or combined portions thereof, and having a general aiming axis extending through an apex of the bowl or dish along a central axis and generally defining an aiming orientation for the lighting fixture to the target area;

adjustable mounting means for positioning the socket means in a desired aiming orientation for the lighting fixture; and offset means for offsetting the longitudinal axis of the art tube of the arc lamp from the aiming direction of the lighting fixture but maintaining a substantial majority of the equator of the arc tube surrounded by the reflector, to maintain the capture and control of a substantial majority of the light emanating from the arc tube the longitudinal axis of the arc tube diverging from the aiming axis of the reflector means but always extending in one direction out of the open face of the reflector means, wherein the longitudinal axis of the arc tube being oriented in a substantially horizontal position during operation of the arc lamp although the axis of the reflector is tilted between 10 to 60 degrees below horizontal so that the reflector maintains capture and control of the light source for a controlled, concentrated beam, but maintains the arc tube substantially horizontally to reduce or eliminate loss of light output from the arc tube caused by tilt factor and to control and reshape the beam configuration.

5. The means of claim 4 wherein the offset means comprises the socket means offset from the aiming axis of the reflector means so that the arc lamp means is offset from the aiming axis of the reflector means.

6. A method for producing light from an arc tube positioned in an arc lamp, where the longitudinal axis of the arc tube is generally coaxial with the longitudinal axis of the arc lamp, and an equator around the middle of the arc tube is generally perpendicular to the longitudinal axis of the arc tube comprising:

mounting the arc lamp into a socket means which is mountable to a support means; and mounting a generally bowl or dish shaped reflector means having an open face to the socket means, the reflector means substantially surrounding the equator of the arc tube to capture and reflectively control a substantial portion of light emanating from the arc tube, but the reflector means having a central aiming axis which is not generally coaxial with the axes of the arc tube and arc lamp the longitudinal axis of the arc tube diverging from the aiming axis of the reflector means but always extending in one direction out of the open face of the reflector means, wherein the longitudinal axis of the arc tube being oriented in a substantially horizontal position during operation of the arc lamp although the axis of the reflector is tilted between 10 to 60 degrees below horizontal so that the reflector maintains capture and control of the light source for a controlled, concentrated beam, but maintains the arc tube substantially horizontally to reduce or eliminate loss of light output from the arc tube caused by tilt factor and to control and reshape the beam configuration.

7. The method of claim 6 wherein the aiming axis of the reflector means is tilted from the axes of the arc tube and arc lamp.

8. The method of claim 6 where the aiming axis of the reflector is offset from the axes of the arc tube and arc lamp.

9. The method of claim 6 wherein the arc lamp extends from the socket means into the reflector means through an aperture which is not centered along the aiming axis of the reflector means but which is closer to a projection of the aiming axis onto the reflector means than to any edge of the reflector means.

10. A lighting fixture comprising:

a mounting means;

an arc lamp having a longitudinal axis mountable to the mounting means;

a generally symmetrical, concave reflector of a rotated three-dimensional shape incorporating at least one of spheroid, paraboloid, ellipsoid, hyperboloid shapes or combined portions thereof, mountable to the mounting means having an aiming axis generally defined by a line through the center of the widest diameter of the reflector, defining an open face of the reflector, and perpendicular to a plane through the center and widest diameter of the reflector;

an arc tube inside the arc lamp, the arc tube having a longitudinal axis and a lateral axis perpendicular to the longitudinal axis; and the longitudinal axis of the arc tube diverging from the aiming axis of the reflector but always extending in one direction out of the open face of the reflector wherein the longitudinal axis of the arc tube being oriented in a substantially horizontal position during operation of the arc lamp although the axis of the reflector is tilted between 10 and 60 degrees below horizontal so that the reflector maintains capture and control of the light source for a controlled, concentrated beam, but maintains the arc tube substantially horizontally to reduce or eliminate loss of light output from the arc tube caused by tilt factor and to control and reshape the beam configuration.

11. The lighting fixture of claim 10 wherein the divergence of the longitudinal axis of the arc tube from the aiming axis of the reflector is accomplished by an entry aperture into the reflector which is offset from an extension of the aiming axis, arc lamp mounting to the mounting means through the aperture.

12. The lighting fixture of claim 11 wherein the divergence of the longitudinal axis of the arc tube from the aiming axis of the reflector is accomplished by attachment means for connecting the reflector to the mounting means, the attachment means being offset from the aiming axis of the reflector.

13. A method of lighting comprising:

mounting an arc lamp into a mounting means, the arc lamp including an arc tube having a longitudinal axis;

positioning the arc lamp inside a generally symmetrical, concave reflector of a rotated shape incorporating at least one of spheroid, paraboloid, ellipsoid, hyperboloid shapes or combined portions thereof, the reflector having an aiming axis generally defined by a line passing through the center of the reflector perpendicular to a plane through the greatest diameter of the reflector, defining an open face of the reflector; and diverging the longitudinal axis of the arc tube from the aiming axis of the reflector but always extending in one direction out of the open face of the reflector, wherein the longitudinal axis of the arc tube being oriented in a substantially horizontal position during operation of the arc lamp although the axis of the reflector is tilted between 10 to 60 degrees below horizontal so that the reflector maintains capture and control of the light source for a controlled, concentrated beam, but maintains the arc tube substantially horizontally to reduce or eliminate loss of light output from the arc tube caused by tilt factor and to control and reshape the beam configuration.

14. The method of claim 13 wherein the divergence of the longitudinal axis of the arc tube from the aiming axis of the reflector is accomplished by inserting the lamp through the reflector at a location offset from the aiming axis of the reflector.

15. The method of claim 13 wherein the divergence of the longitudinal axis of the arc tube from the aiming axis of the reflector is accomplished by adjusting the position of the arc lamp with respect to the reflector.

* * * * *

Disclaimer 5,016,150—Myron K. Gordon; Jim L. Drost, both of Oskaloosa, Iowa. MEANS AND METHOD FOR INCREASING OUTPUT, EFFICIENCY, AND FLEXIBILITY OF USE OF ARC LAMP. Patent dated May 14, 1991. Disclaimer filed Nov. 12, 1997, by the assignee, Musco Corporation.

Hereby enters this disclaimer to claims 1-15 of said patent.

*(Official Gazette,* June 2, 1998)